US008867762B2

(12) United States Patent
Lund

(10) Patent No.: US 8,867,762 B2
(45) Date of Patent: Oct. 21, 2014

(54) AUDIO TOWING HANDLE

(76) Inventor: Jonathan Jack Lund, Lehi, UT (US)

( * ) Notice: Subject to any disclaimer, the term of this patent is extended or adjusted under 35 U.S.C. 154(b) by 446 days.

(21) Appl. No.: 13/154,552

(22) Filed: Jun. 7, 2011

(65) Prior Publication Data

US 2012/0314894 A1 Dec. 13, 2012

(51) Int. Cl.
*H04R 5/02* (2006.01)
*B63B 35/85* (2006.01)
*H04R 1/02* (2006.01)

(52) U.S. Cl.
CPC ..... *H04R 1/028* (2013.01)
USPC ..... 381/300; 441/69

(58) Field of Classification Search
CPC ..... H04S 1/00; H04R 3/00; B63B 35/81; B63B 35/815; B63B 35/817
USPC ..... 381/1, 111, 105, 300, 301, 302, 333, 381/334; 441/69
See application file for complete search history.

(56) References Cited

U.S. PATENT DOCUMENTS 3,952,155 A * 4/1976 Novak ..... 379/176
4,624,141 A 11/1986 Soleau
5,167,550 A * 12/1992 Nielsen ..... 440/84
5,343,189 A 8/1994 Alley, Sr.
5,408,221 A 4/1995 Carsella, Sr. et al.
7,109,871 B2 9/2006 Lentine et al.
2005/0073442 A1* 4/2005 Lentine et al. ..... 340/984
2007/0287597 A1* 12/2007 Cameron ..... 482/8

FOREIGN PATENT DOCUMENTS

CN 201146903 Y * 11/2008

* cited by examiner

*Primary Examiner* — Vivian Chin
*Assistant Examiner* — William A. Jerez Lora
(74) *Attorney, Agent, or Firm* — Brian D. Owens

(57) ABSTRACT

One embodiment provides a system and method for an audio handle. The audio handle includes a rope, the rope including a first end operable to be attached to a vehicle for towing a user. The audio handle further includes a handle connected to the rope. The handle includes one or more speakers operable to communicate an audio signal to the user. The rope includes one or more wires for communicating an electronic audio signal from an audio source of the vehicle to the speakers to generate the audio signal. The first end includes an audio jack for connecting the one or more wires to the audio source to receive the electronic audio signal.

19 Claims, 5 Drawing Sheets

AUDIO TOWING HANDLE

BACKGROUND

Participation in recreational activities has grown in recent years as more and more individuals are introduced to activities and sports, such as waterskiing, wakeboarding, kite boarding, knee boarding, snow skiing, snowmobiling, rollerblading, skateboarding, and so forth.

In many of these activities or sports one or more individuals may be pulled, towed, or transported behind a vehicle. In many cases, the individuals may be towed utilizing a rope and handle system, such towing systems have not kept pace with other technological advances that individuals have come to expect on a daily basis.

SUMMARY

One embodiment provides a system and method for an audio handle. The audio handle may include a rope, the rope including a first end operable to be attached to a vehicle for towing a user. The audio handle may further include a handle connected to the rope. The handle includes one or more speakers operable to communicate an audio signal to the user. The rope may include one or more wires for communicating an electronic audio signal from an audio source of the vehicle to the speakers to generate the audio signal. The first end may include an audio jack for connecting the one or more wires to the audio source to receive the electronic audio signal.

Another embodiments provides a wireless audio handle. The wireless audio handle may include a handle connectable to a rope for towing a user. The wireless audio handle may also include a receiver operable to wirelessly receive electronic audio signals wirelessly from a transmitter of a vehicle. The transmitter may receive the electronic audio signals from an audio source. The wireless audio handle may also include one or more speakers connected to the receiver, the one or more speakers operable to output an audio signal to the user.

Yet another embodiment provides a method for providing audio content through a tow rope. An electronic audio signal is received from an audio source of a vehicle. The electronic audio signal is played as an audio signal. The audio signal may be played by one or more speakers integrated with a handle utilized for towing a user behind the vehicle.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE DRAWINGS

The illustrative embodiments provide an audio handle 100 and a system and method for utilizing the audio handle 100.

The audio handle 100 may be utilized to tow one or more individuals or users. Towing as herein defined includes pulling, transporting, or otherwise applying a force for moving the user from one location or position to another. The audio handle 100 may be utilized to provide an audio signal to the user during any number of sports or recreational activities. For example, it is well known that many individuals prefer to engage in sporting or recreational activities while listening to their favorite music. In many of the described recreational activities and sports, it is impractical to wear an mP3 player or other audio generating device. Additionally, the user may be so far away from the vehicle that any audio played from audio sources in or on the vehicle may be unhearable or faint. The audio handle 100 as herein described may be utilized to communicate audio content or an audio signal to a user utilizing the audio handle 100. The audio handle 100 may also be utilized to increase the "fun factor" or pump up a user for the activity in which they are involved. Additionally, the user does not have to worry about losing or damaging audio equipment because the audio system 500 interface or speakers 106 are integrated with the audio handle 100 as herein described.

Furthermore, the speakers 106 and other electronic components of the audio handle 100 are waterproof, shock proof and resistant to any damage that may occur during the normal use of the audio handle 100 including, but not limited to, submersion, dragging, crashes, tricks, or normal wear and tear. The audio handle 100 as herein described may be utilized in a wired embodiment or a wireless embodiment. In either embodiment, the audio handle 100 may receive electronic audio signals 508 from an audio source integrated with or accessible on the vehicle attached to the audio handle 100.

Figure 1:
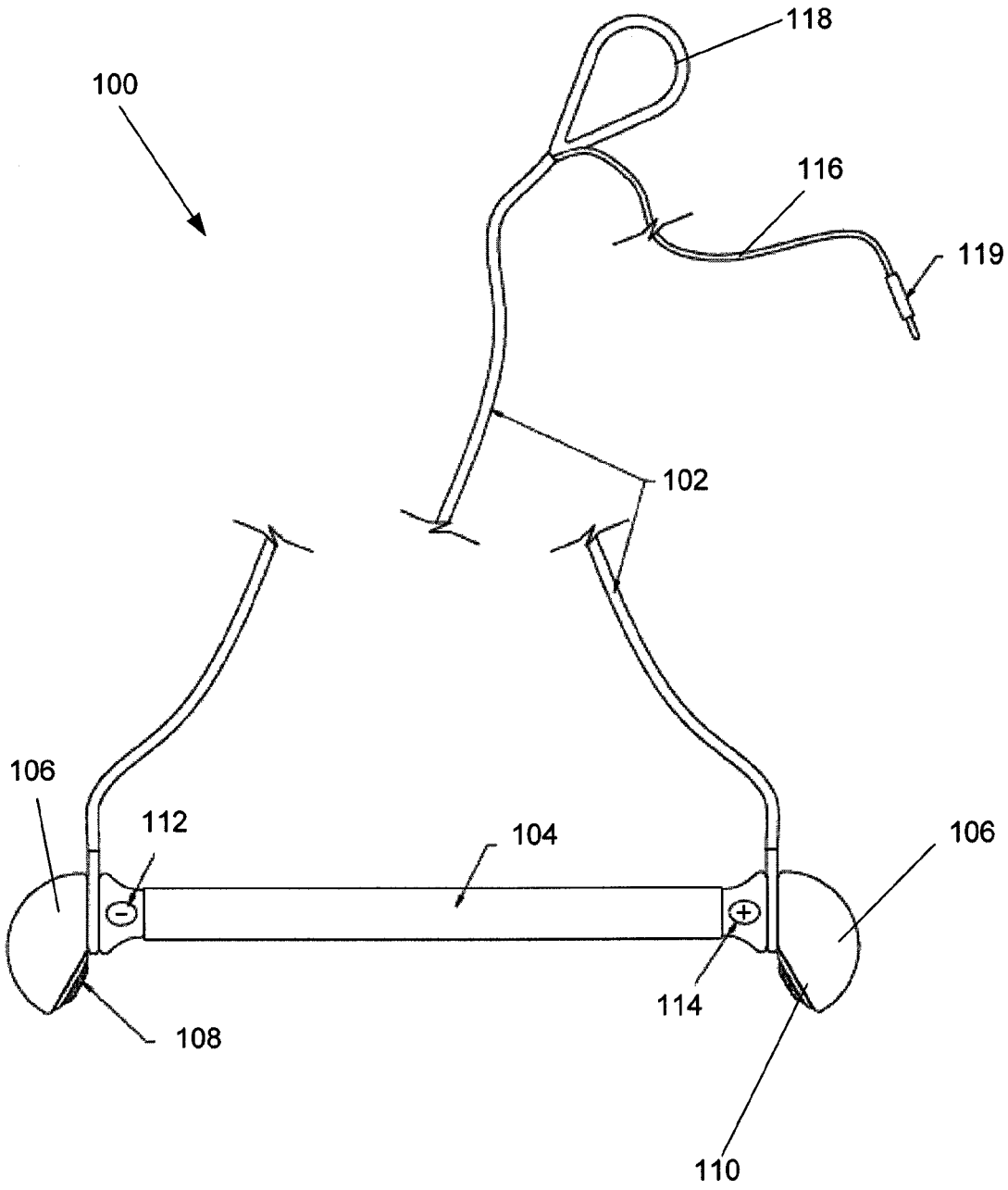
FIG. 1 is a pictorial representation of an audio handle in accordance with an illustrative embodiment.

FIG. 1 is a pictorial representation of an audio handle 100 in accordance with an illustrative embodiment. The audio handle 100 is one embodiment of an audio towing system that may be utilized in any number of recreational activities, sports, or other pursuits in which towing a user is required.

The audio handle 100 may be configured to include any number of components and elements. In one embodiment, the audio handle 100 includes a rope 102, a handle 104, speakers 106 including a left speaker 108 and a right speaker 110, volume controls 112 and 114, an extension 116, a coupler 118, and an audio jack 119. The illustrative embodiments may be combined in any number of formats or configurations that are not specifically called out or described herein.

In one embodiment, the rope 102 is a braided rope 102 configured to not stretch or have limited stretching even when the rope 102 becomes wet. The types and configurations of the rope 102 are numerous and are well known to individuals of skill in the art for the particular industries and endeavors herein described. The rope 102 may attach to the handle 104 in a single point or multiple points. In one embodiment, the rope 102 may be split for a left and right hand side of the handle 104, respectively. Similarly, the wires within the rope 102 may also be split to supply electronic audio signals 508 to the left speaker 108 and right speaker 110, respectively. In another embodiment, the rope 102 may attach to the handle 104 at a single point with the wires internal to the rope 102 being routed through the handle 104 to the speakers 106.

In one embodiment, the rope 102 and the handle 104 may be integrated as a single unit. In another embodiment, the rope 102 and the handle 104 may be detachably connected. For example the rope 102 may attach to the handle 104 and include one or more interface, such as a port, for connecting the wires to the speakers 106. For example, banana plugs and banana receptors may be utilized to connect the wire of the rope 102 to the speakers 106. Any number of other common audio interfaces (i.e. plugs and ports) may also be utilized.

In one embodiment, the handle 104 is a solid handle 104 with a foam coating 402 or surface that is utilized to cushion the user's hands while pulling the user with the audio handle 100. The handle 104 may alternatively use any number of other non-slip or cushioned surfaces for the comfort of the user. In one embodiment, the handle 104 may include one or more sensors. In one embodiment, the handle 104 includes a pressure sensor for disabling the speakers 106 in response to the handle 104 not being held or gripped by the user. The pressure sensor may extend across all or a portion of the handle 104. Although not specifically shown, the handle 104 may include a number of sensors for detecting when the handle 104 is immersed in water, being dragged, or otherwise not being held or utilized by the user. These different sensors may incorporate switches or relays and may be utilized to turn the speakers 106 off or to otherwise disable the audio features of the audio handle 100.

In another embodiment, the handle 104 may include a hollow portion for securing an mp3 player or other audio generation device. A port or audio jack 119 within the hollow portion may allow the speakers 106 to broadcast an audio signal received from the mp3 player. In another embodiment, a special mp3 player may be configured to screw into a side of the handle 104. Contacts within the side of the special mp3 player may communicate the electronic audio signal 508 to the speakers 106 for playback. In such an embodiment, the handle 104 may also include batteries for powering the speakers 106 without being powered through the rope 102.

The speakers 106 are electronic output devices. In one embodiment, the speakers 106 may be one inch waterproof speakers 106 that are sealed within left and right ends of the handle 104. However, the speakers 106 may be any number of sizes and configurations based on durable speakers 106 known in the art. In one embodiment, the speakers 106 may be integrated with the handle 104. In another embodiment, the speakers 106 may be attachably or detachably added to or removed from the handle 104 in order to provide the user holding the handle 104 with audio signals such as music, instructions, or other feedback. For example, the speakers 106 may slidably attach to the handle 104. The handle 104 may include contacts for communicating the electronic audio signals 508 to the speakers 106. The handle 104 may further define rails, ports, locking tabs or other securing mechanisms for ensuring that the speakers 106 remain attached during use.

In one embodiment, the audio handle 100 may include volume controls 112 and 114. The volume controls 112 and 114 may be utilized to increase or decrease the volume of the audio signal played through the speakers 106. The volume controls 112 and 114 may be buttons, dials, or grip indicators or other interface elements for receiving a user selection for increasing or decreasing the volume of the audio signal played by the speakers 106. In one embodiment, the volume controls 112 and 114 may be integrated, such as a rotating selector integrated with the handle 104.

The audio handle 100 may further include an interface for communicating signals from the audio handle 100 through the rope 102 to the vehicle. In one embodiment, the user may provide feedback regarding speed (increase, decrease, maintain), direction (left, right, and varying degrees), or other specific input, such as stop or user programmable feedback or instructions. In particular, the interface may include buttons, knobs, touch interfaces, scroll wheels, and other indicators.

In one embodiment, the handle 104 may include batteries for further amplifying the electronic audio signals 508 or otherwise powering the speakers 106. In some cases, the batteries may be useful due to attenuation of the electronic audio signal 508 as communicated from the audio source of the vehicle. The audio handle 100 may also include a user selector for turning the speakers 106 on and off. The selector may be a switch, button, or other interface.

In one embodiment, the audio handle 100 may be powered on by the user pressing and holding the volume control 114 for two or more seconds. Similarly, holding the volume control 114 for two or more seconds once the audio handle 100 is already activated with sound being played through the speakers 106 may turn off the speakers 106 or alternatively an audio source communicating with the audio handle 100, such as an mP3 player, boat transmitter or radio, or other audio device.

In another embodiment, the sensors such as an immersion sensor or drag sensor may communicate a signal through the audio jack 119 indicating that the user is no longer being pulled by the audio handle 100. For example, an alert may be played by a stereo system of the vehicle indicating that the audio handle 100 is immersed, dragging, or not being held by the user. As shown, the coupler 118 is an interface for connecting the audio handle 100 to a towing or pulling vehicle. In one embodiment, the coupler 118 is a braided and looped portion of the rope 102 that may be connected to a latch mechanism of the vehicle.

In another embodiment, the coupler 118 may include a latch mechanism, such as an integrated or external carabineer for securing the audio handle 100 to the vehicle. The coupler 118 may also be other rope 102 elements or connectors known in the art. The extension 116 extends from the rope 102 and at one end and includes the audio jack 119. The extension 116 may allow the audio jack 119 to be connected to an audio source or media device on or aboard the vehicle. As described herein, the communications from the audio source to the audio handle 100 may occur uni-directionally. In another embodiment, the communications to and from the audio handle 100 may occur bi-directionally. For example, the audio handle 100 may include logic 506 for processing user selections through an interface to provide audible instructions or feedback to users in, on, or aboard the vehicle, such as "speed up", "slow down', "stop", "go left", "go right."

For example, the extension 116 may be connected to a car stereo or a boat CD changer and radio as well as the interconnected speaker system. Alternatively, the audio jack 119 may be connected to an audio source external to the vehicle, but that is aboard the vehicle. For example, the audio jack 119 may be connected to an mP3 player, CD player, satellite radio device, telephone, or other computing communications or media device. The extension 116 may be anywhere from three feet to twenty feet long or longer as needed. In some embodiments, the vehicle may include a port configured to receive the audio jack 119 near a port operable to receive the coupler 118. As a result of the extension 116, it may not need to be as long. However, some older devices may require a very long extension 116 to connect the audio jack 119 to the audio source.

In one embodiment, the audio jack 119 is an RCA jack or other jack configured to communicate one or more electronic signals simultaneously. As further described herein, the rope 102 and the extension 116 may include one or more wires or communicating mediums for communicating electronic audio signals 508 to the left speaker 108 and right speaker 110 that utilize the electronic audio signals 508 to produce audio signals that are audible or played to the user. The wires or communication medium within the rope 102 and extension 116 may be braided, shielded, coated, or otherwise protected to prevent interference with communication of the electronic audio signals 508 along the length of the audio handle 100 during utilization.

Figure 2:
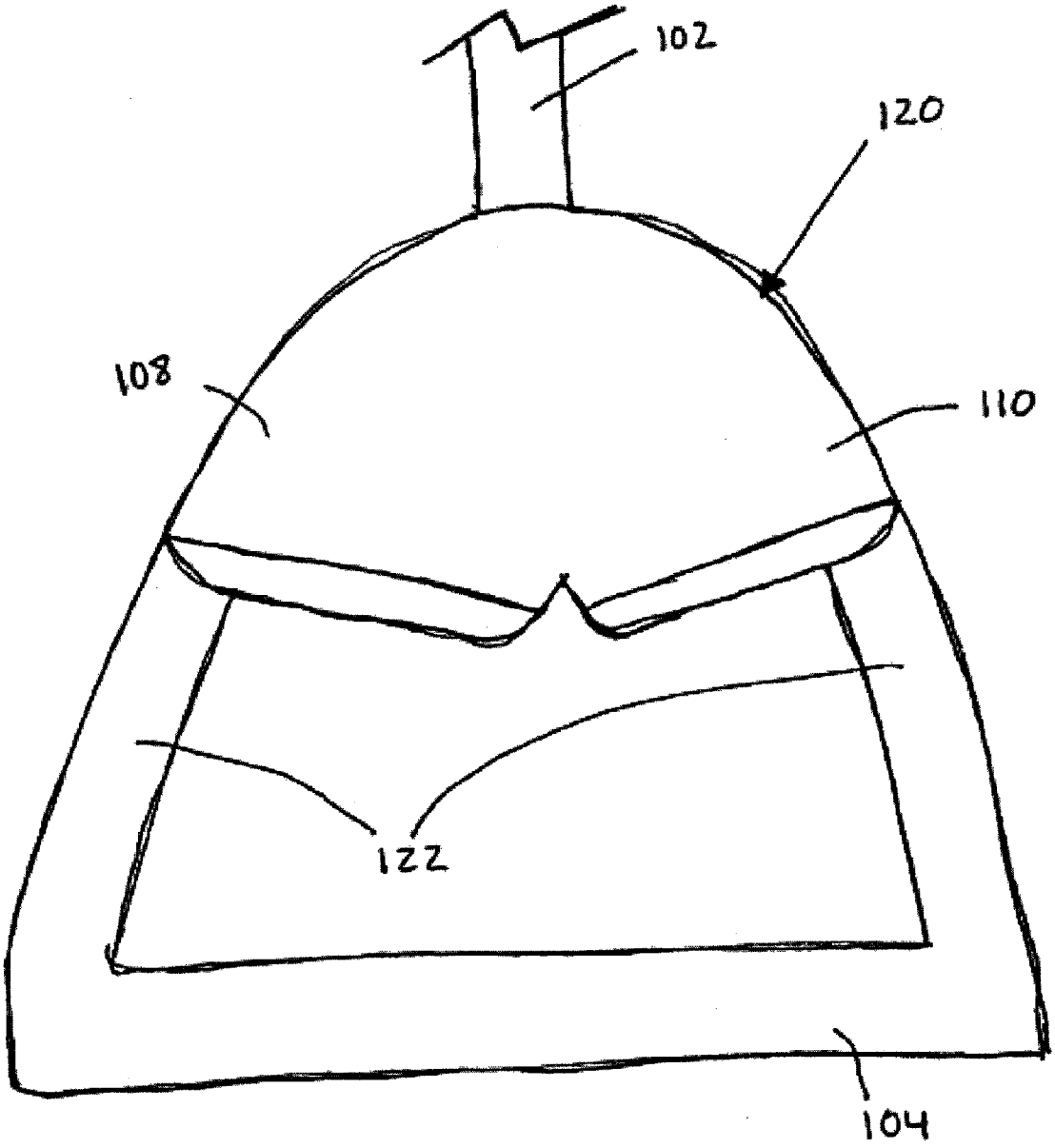
FIG. 2 is a pictorial representation of an audio handle in accordance with another illustrative embodiment.

FIG. 2 is a pictorial representation of an audio handle 100 in accordance with another illustrative embodiment. The audio handle 120 represents a second embodiment. The rope 102 may connect to the audio handle 120 at a single point. In another embodiment, the rope 102 and the audio handle 120 may be integrated. The audio handle 120 may secure the rope 102 utilizing a receptacle or other securing mechanism so that the rope 102 and handle 104 may be interchangeable with any number of other ropes and handles.

As shown, the left speaker 108 and right speaker 110 may be positioned next to each other. The supports 122 secure the left speaker 108 and the right speaker 110 as well as the handle 104. In one embodiment, the supports 122 represent a frame 132 to which the left speaker 108 and right speaker 110 may be permanently or temporarily affixed. In one embodiment, the frame 132 may be molded from plastic with the wiring and electronics integrated within internal compartments. The left speaker 108 and right speaker 110 may be removed or added to the audio handle 120 with different ropes attached at any time to provide maximum flexibility.

Figure 3:
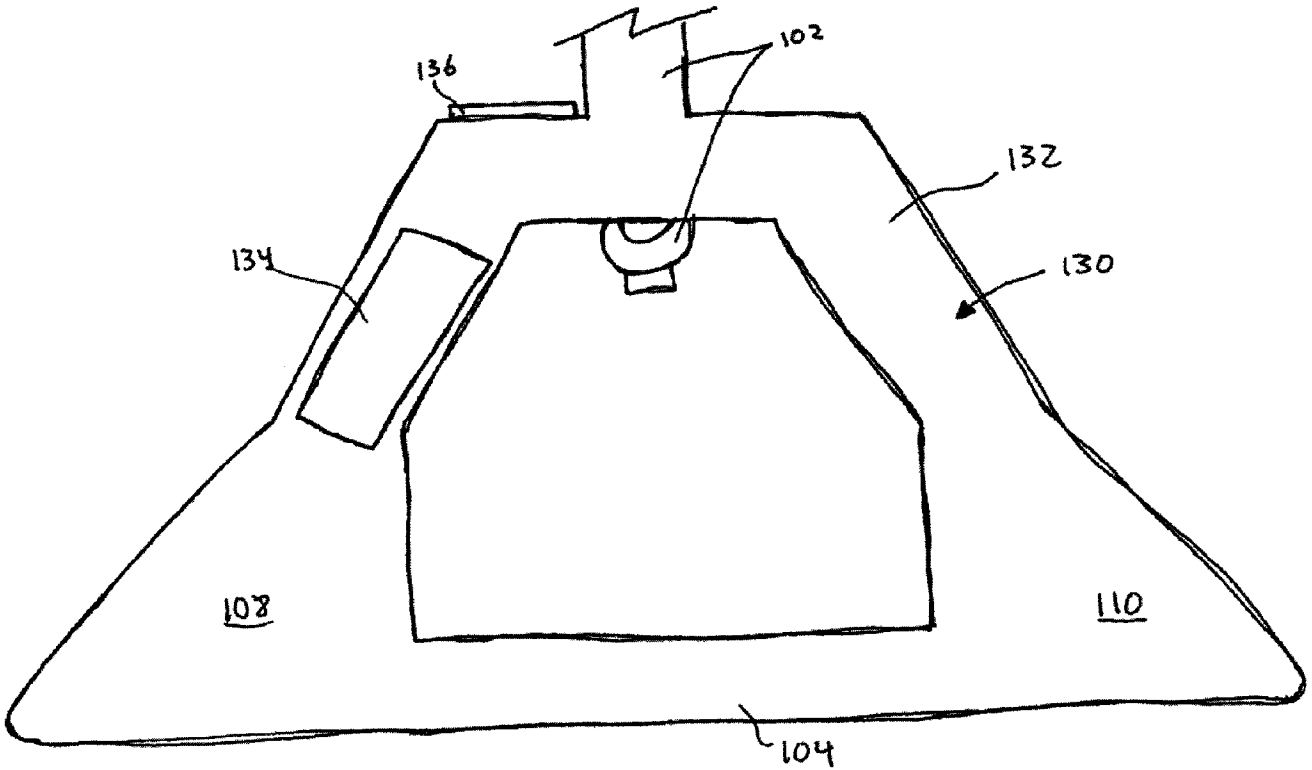
FIG. 3 is a pictorial representation of an audio handle configured for wireless communication in accordance with an illustrative embodiment.

FIG. 3 is a pictorial representation of an audio handle 100 configured for wireless communication in accordance with an illustrative embodiment. The audio handle 130 may include any number of elements or components including the rope 102, the handle 104, the left speaker 108, the right speaker 110, a frame 132, a battery compartment 134, and an antenna 136. The audio handle 130 may further include the circuitry and elements shown in FIG. 5.

The frame 132 of the audio handle 130 may secure the left speaker 108 and the right speaker 110 for directing the audio signals directly at the user. In various embodiments, the left speaker 108 and right speaker 110 may be additionally directed to focus the sound at the user. The handle 104 is secured between the left speaker 108 and the right speaker 110. In one embodiment, the audio handle 130 may be a single composite element including the frame 132 and the handle 104.

The audio handle 130 may include one or more battery compartments for securing batteries for powering the circuitry including the speakers 106. The antenna 136 is operable to receive electronic audio signals 508 transmitted from the vehicle or from other sources. In one embodiment, the vehicle, such as a boat, may include a transmitter or transceiver 504 matched with the antenna 136 and receiver/transceiver 504 of the audio handle 130. In another embodiment, the antenna 136 may be configured to receive AM/FM or other forms of electronic audio signals 508.

The antenna 136 may also broadcast audio signals to the media system of the vehicle, such as speed or directional feedback based on controls integrated with the audio handle 130. In one embodiment, the audio handle 130 may also include a microphone that may be activated to record speech from the user and convert the speech to wireless or electronic signals communicated to the vehicle. As a result, the user of the audio handle 130 may audibly specify for the user to "slow down", "speed up, "stop", "avoid the other skiers", or receive any other verbal instructions from the user based on selection of the microphone. The verbal instructions may be played through the speaker systems of the vehicle for the benefit of the user and operator of the vehicle.

In another embodiment, the audio handle 130 may be a stand-alone handle 104 that includes a compartment and internal jack for receiving an mp3 player for playing the audio signals through the speakers 106 rather than the antenna 136. A stand-alone audio handle 100 may be particularly useful for sports or pulling activities that do not utilize a vehicle or that utilize a vehicle that does not include an audio source, such as kite-boarding, towing utilizing a snowmobile or four-wheeler, hang gliding, and so forth.

Figure 4:
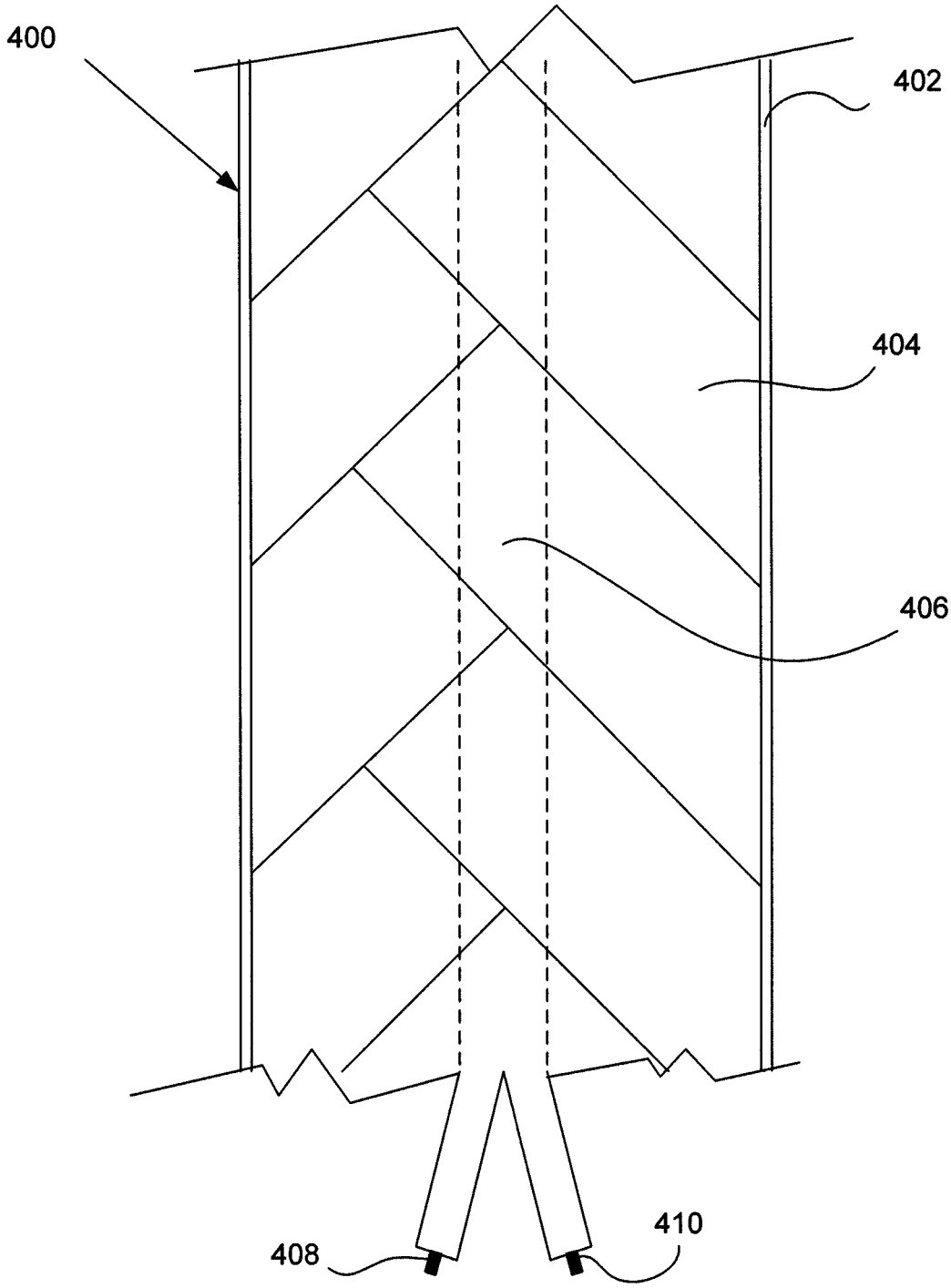
FIG. 4 is a cutaway view of a rope for an audio handle in accordance with an illustrative embodiment.

FIG. 4 is a cutaway view of a rope 102 for an audio handle 100 in accordance with an illustrative embodiment. FIG. 4 illustrates on embodiment of a rope 400 utilized for an audio handle 100. The rope 400 may include a coating 402, a braided support 404, and a speaker wire 406. The speaker wire 406 may include a left input 408 and a right input 410 for driving a left speaker 108 and right speaker 110, respectively.

In one embodiment, the rope 400 includes the coating 402. The coating 402 may be an entire layer, such as plastic that protects the braided support 404. For example, the coating 402 may be a thin plastic layer that waterproofs the rope 400. Alternatively, the coating 402 may be a spray on treatment that enhances the braided support 404. The coating 402 may also be any number of other coatings known in the art.

The braided support 404 is the load bearing portion of the rope 400. The braided support 404 may include any number of fibers, ropes or other elements that are braided around the speaker wire 406. The braided support 404 and speaker wire 406 are positioned, such that the load of pulling a user is only born by the braided support 404 and not the speaker wire 406 to ensure sound quality and longevity of the rope 400 and the audio handle 100. In another embodiment, the speaker wire 406 may actually be braided as part of the braided support 404.

The speaker wire 406 communicates the electronic audio signals 508. The speaker wire 406 may include one or more wires or conductors, such as left input 408 and right input 410. The speaker wire 406 may utilize any number conductors, such as copper, copper oxides, aluminum, silver, gold. The speaker wire 406 as well as the left input 408 and the right input 410 may include any number of insulation or cladding layers. For example, the conductors may be insulated by plastic such as PVC, PE or Teflon. The gauge of the conductor within the speaker wire 406 may vary based on the designated length of the rope 102. In one example, a rope 102 of approximately 50 feet in length may be best suited for 16 gauge conductors in the left input 408 and right input 410. The left input 408 and right input 410 may connect directly to the speakers 106 or other circuitry of the audio handle 100. Alternatively, any number of termination elements, such as banana plugs may be integrated with either end of the rope 400 for receiving and communicating the electronic audio signals 508. The rope 400 may also be operable for bi-directional communications to and from the audio handle 100.

Figure 5:
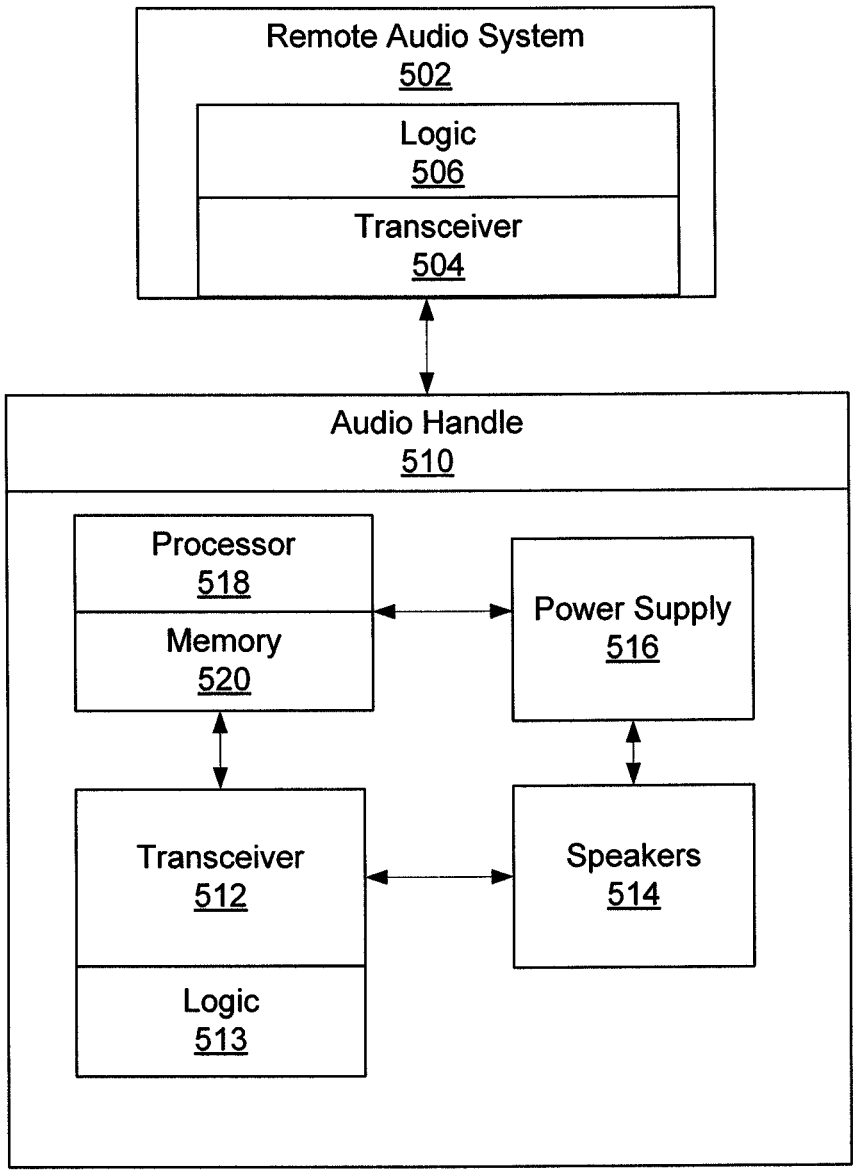
FIG. 5 is a block diagram of an audio system enabling the audio handle in accordance with an illustrative embodiment.

FIG. 5 is a block diagram of an audio system 500 enabling the audio handle 100 in accordance with an illustrative embodiment. One embodiment, of an audio system 500 includes a remote audio system 502 including a transceiver 504 and logic 506. The remote audio system 502 may communicate an electronic audio signal 508 to an audio handle 510. The audio handle 510 may include a transceiver 512, logic 513, speakers 514, a power supply 516, a processor 518, and a memory 520. The transceivers 504 and 512 may utilize any number of wireless communications standards and protocols including Bluetooth, Wifi, point-to-point frequencies, and other commercially available spectrums.

The remote audio system 502 may represent an audio system 500 within the vehicle, such as a car or boat stereo system. The logic 506 may be digital logic 506 operable to control communication or playback of media content that is communicated from or received by the transceiver 504. The logic 506 may include logic 506 for determining the amplitude of the electronic audio signal 508 communicated to or received from the audio handle 510. The logic 506 may potentially include hardware and software elements. The logic 506 may also include a processing element, controller, memory 520, amplifier, buffers, and other similar equipment.

In one embodiment, the transceiver 504 only includes a transmitter for communicating the electronic audio signal 508 to the audio handle 510. In another embodiment, the transceiver 504 is a standard transmitter and receiver that may transmit and receive electronic signals to and from the audio handle 510, respectively.

In one embodiment, the audio handle 510 may be configured as simply as possible. For example, the audio handle 100 may include the transceiver 512 for receiving and configuring the electronic audio signal 508 and the speakers 514 with the speakers 106 being powered by the power supply 516. The power supply 516 may be batteries, a solar cell, fuel cell, or other element that provides electricity. The audio handle 510 may also include the logic 513. The logic 513 may manage and control operation of the audio handle 100. For example, the logic 513 may include amplifiers, a user interface (i.e. volume control 114 buttons), and other elements. In one embodiment, the logic 506 may also include a power button for activating or deactivating the audio handle 510. The logic 513 may also include any number of sensors including pressure sensors, immersion or water sensors, drag detectors, accelerometers, or other elements configured to turn off or disable the audio handle 510 in response to determining the audio handle 510 is not being held by a user or being pulled behind the vehicle without the user (i.e. dragging). The logic 513 may also control operation of a microphone (not shown) and microphone input.

In one embodiment, the processor 518 and memory 520 may be included in the audio handle 100 for processing the electronic audio signals 508 for playback as the audio signal by the speakers 514. In addition, the processor 518, memory 520, and logic 506 may function as an internal mp3 player. For example, the memory 520 may store songs or other content that has been uploaded wirelessly through the transceiver 512 or through a port (i.e. mini or micro USB) of the audio handle 510. The transceiver 512 may also be enabled to receive WiFi, Bluetooth, or other wireless signals for data transfers.

The speakers 514 represent one or more speakers 106 that convert the electronic audio signals 508 to audio signals played to the user of the audio handle 510.

The previous detailed description is of a small number of embodiments for implementing the invention and is not intended to be limiting in scope. The following claims set forth a number of the embodiments of the invention disclosed with greater particularity.

What is claimed:

1. An audio handle comprising:

a rope including a first end operable to be attached to a vehicle for towing a user; and a handle connected to the rope, the handle including a plurality of speakers operable to communicate audio signals to the user, the rope includes one or more wires for communicating the audio signals from a stereo system of the vehicle to the plurality of speakers to output the audio signal, the rope is braided to prevent straining the one or more wires, the first end of the rope including an audio jack extending from the rope for connecting to the stereo system to receive the audio signals; and a pressure switch operable to disable the plurality of speakers from communicating the audio signals in response to determining the user is not holding the handle, the plurality of speakers are disabled in response to determining the audio handle is immersed in water.

2. The audio handle of claim 1, wherein the first end includes a coupler for attaching the rope to the vehicle.

3. The audio handle of claim 1, wherein the plurality of speakers include a left speaker and a right speaker positioned on a left side and a right side of the handle, respectively, and wherein the audio signals are music from the stereo system.

4. The audio handle of claim 1, further comprising:

volume adjustments for increasing or decreasing volume of the audio signal.

5. The audio handle of claim 4, where the one or more speakers are waterproof and shock proof.

6. The audio handle of claim 4, wherein the plurality of speakers are attachable and detachable from the handle.

7. The audio handle of claim 4, wherein the handle and the rope are integrated.

8. The audio handle of claim 1, wherein the handle further includes a control for turning on or off the speakers.

9. The audio handle of claim 1, further comprising:

batteries within the handle for powering the plurality of speakers; and volume adjustments integrated with the handle for increasing or decreasing volume of the audio signal output through the plurality of speakers.

10. A wireless audio handle comprising:

a rope including a first end operable to be attached to a vehicle;

a handle connectable to the rope for towing a user;

a receiver operable to wirelessly receive electronic audio signals wirelessly from an audio source in the vehicle, wherein the audio source includes at least a stereo system in the vehicle;

a plurality of speakers connected to the receiver, the plurality of speakers operable to output an audio signal to the user, wherein the rope includes one or more wires for communicating the electronic audio signals from the audio source in the vehicle to the plurality of speakers to output the audio signal, the rope is braided to prevent straining the one or more wires, the first end of the rope includes an audio jack extending from the rope for connecting to the stereo system to receive the electronic audio signals;

a pressure switch operable to disable the plurality of speakers from communicating the audio signal to the user in response to determining the user is no longer holding the handle; and a sensor operable to disable the plurality of speakers from communicating the audio signal to the user in response to detecting the handle is immersed in water.

11. The wireless audio handle of claim 9, further comprising:

batteries within the handle for powering the plurality of speakers; and volume adjustments integrated with the handle for increasing or decreasing volume of the audio signal output through the plurality of speakers.

12. The wireless audio handle of claim 9, wherein the handle and the rope are integrated.

13. The wireless audio handle of claim 9, wherein the plurality of speakers are attachable and detachable from the handle.

14. The wireless audio handle of claim 9, where the one or more speakers are waterproof and shock proof.

15. A method for providing audio content through a towing handle, comprising:

receiving electronic audio signals from an audio source of a vehicle through a rope that is braided to prevent straining of one or more wires within the rope that communicate the electronic audio signals, wherein the audio source communicates with at least a stereo system in the vehicle through at least an audio jack extending from the rope, the rope includes a first end operable to be attached to the vehicle and a second end connected to the towing handle for towing a user;

playing the electronic audio signals as audio signals, the audio signals being played by one or more speakers integrated with the towing handle utilized for towing a user behind the vehicle; and disabling the one or more speakers from playing the audio signals in response to one or more sensors determining the user is no longer holding the towing handle or the towing handle is immersed in water.

16. The method of claim 15, wherein the electronic audio signals are communicated to a receiver that wirelessly communicates with the audio source.

17. The method of claim 15, wherein the electronic audio signal is communicated wirelessly from a transmitter of the vehicle to a receiver integrated with the towing handle and connected to the one or more speakers.

18. The method of claim 16, wherein the towing handle and the rope are integrated.

19. The method of claim 18, further comprising:

adjusting a volume of the audio signal in response to a user selecting a volume adjustment, wherein the one or more speakers are removably attached to the towing handle.

* * * * *